US012669027B2

(12) United States Patent
Simpson

(10) Patent No.: US 12,669,027 B2
(45) Date of Patent: Jun. 30, 2026

(54) DRILL CUTTINGS AGITATOR

(71) Applicant: Neil Andrew Abercrombie Simpson, Aberdeen (GB)

(72) Inventor: Neil Andrew Abercrombie Simpson, Aberdeen (GB)

(73) Assignee: Paradigm Drilling Services Limited, Aberdeen (GB)

( * ) Notice: Subject to any disclaimer, the term of this patent is extended or adjusted under 35 U.S.C. 154(b) by 0 days.

(21) Appl. No.: 18/575,496

(22) PCT Filed: Jul. 4, 2022

(86) PCT No.: PCT/GB2022/051722

§ 371 (c)(1),
(2) Date: Dec. 29, 2023

(87) PCT Pub. No.: WO2023/281251

PCT Pub. Date: Jan. 12, 2023

(65) Prior Publication Data

US 2024/0295156 A1 Sep. 5, 2024

(30) Foreign Application Priority Data

Jul. 4, 2021 (GB) ..... 2109654

(51) Int. Cl.
*E21B 31/00* (2006.01)
*E21B 21/00* (2006.01)

(52) U.S. Cl.
CPC ..... *E21B 31/00* (2013.01); *E21B 21/00* (2013.01)

(58) Field of Classification Search
CPC ..... E21B 37/00; E21B 31/00; E21B 21/00; E21B 17/22; E21B 17/1042
See application file for complete search history.

(56) References Cited

U.S. PATENT DOCUMENTS

| | | | | |
|---|---|---|---|---|
| 4,984,633 | A | 1/1991 | Langer et al. | |
| 9,834,991 | B2 | 12/2017 | Simpson | |
| 2011/0048803 | A1 | 3/2011 | Robson et al. | |
| 2011/0114307 | A1 | 5/2011 | Casassa et al. | |
| 2014/0158432 | A1* | 6/2014 | Simpson | E21B 17/1057 175/73 |
| 2016/0237764 | A1* | 8/2016 | Jellison | E21B 17/22 |

FOREIGN PATENT DOCUMENTS

| | | | |
|---|---|---|---|
| DE | 29703655 | U1 | 12/1997 |
| WO | WO-2014126481 | A2 | 8/2014 |
| WO | WO-2020188057 | A1 | 9/2020 |

OTHER PUBLICATIONS

International Search Report and Written Opinion for International Application No. PCT/GB2022/051722 dated Jul. 4, 2022.
International Preliminary Report on Patentability on PCT/GB2022/051722 dated Jan. 18, 2024.

* cited by examiner

*Primary Examiner* — Nicole Coy
*Assistant Examiner* — Nicholas D Wlodarski
(74) *Attorney, Agent, or Firm* — Harness, Dickey & Pierce, P.L.C.

(57) ABSTRACT

In one embodiment, the drill cuttings agitator includes an elastomeric sleeve and a plurality of agitator members extending radially from the elastomeric sleeve.

32 Claims, 7 Drawing Sheets

DRILL CUTTINGS AGITATOR

This application is a national phase under 35 U.S.C. § 371 of PCT International Application No. PCT/GB2022/051722 which has an International filing date of Jul. 4, 2022 which claims priority to United Kingdom Application No. 2109654.0, filed Jul. 4, 2021 the entire contents of each of which are hereby incorporated by reference.

FIELD

This relates to a drill cuttings agitator for agitating drill cuttings in a borehole, a downhole tool comprising one or more of the drill cuttings agitators, a downhole system comprising one or more of the drill cuttings agitators and/or the downhole tools, a method of agitating drill cuttings using the drill cuttings agitator, the downhole tool and/or the downhole system, a method of installing a drill cuttings agitator on a tubular body, and an assembly for installing a drill cuttings agitator on a tubular body.

BACKGROUND

In the oil and gas industry, in order to access hydrocarbons from a formation, a borehole ("wellbore") is drilled from surface. The wellbore is then lined with sections of bore-lining metal tubulars, known as casing, and production infrastructure installed to facilitate the ingress of hydrocarbons into the wellbore and transport them to surface.

The development of directional drilling techniques has facilitated the creation of high angle and horizontal wellbores (referred to below collectively as horizontal wellbores) which deviate from vertical and thus permit the wellbore to follow the hydrocarbon bearing formation to a greater extent. Amongst other things, horizontal wellbores beneficially facilitate increased production rates due to the greater length of the wellbore which is exposed to the reservoir.

In view of the benefits of horizontal wellbores, there is a continuing desire to extend the length or "reach" of horizontal wellbores.

As more extended reach horizontal wellbores are drilled, drill cuttings settling on the low side of the borehole—and which form sediments commonly known in the industry as low side cuttings beds—are posing greater problems for operators. If left in place, low side cuttings beds can lead to significant difficulties in pulling the drill string from the borehole and, in some cases, can cause the drill string to become stuck. In extreme cases, the inability to pull the drill string from the wellbore risks parting the drill string in the wellbore and possible loss of the wellbore itself.

In view of the above, cleaning of the borehole becomes a critical factor in the effective drilling of horizontal boreholes. While good quality mud systems and maintaining high flow rates in the borehole annulus can be used to mitigate the problems created by low side cuttings beds by minimising their ability to form in the first place, these are not always successful for a variety of reasons. For example, the mud systems may not always be operating at their optimum efficiency. Alternatively or additionally, the return flow velocity in the annuls may be lower than desired due, e.g. to limitations of the surface equipment or the borehole conditions, such as the tortuosity of the borehole creating settlement areas which inhibit the ability to circulate low side cuttings out of the borehole.

If low side cuttings beds cannot be circulated out of the borehole, operators may then employ cuttings bed agitator (CBA) tools to facilitate the removal of drill cuttings beds. CBA tools are sub-based tools with a paddle-type or bladed central section designed to create local turbulence when rotated as a part of the drill string. The subs are generally a metre or more in length with American Petroleum Institute (API) connections top and bottom to enable them to be installed between sections of drill pipe, typically in the lower section of the drill string that is rotating in the high angle sections of the borehole where the low side cuttings beds tend to form. CBA tools are typically run in large numbers in the drill string, often with 50 or more tools being run at the same time.

Although effective in agitating the low side cuttings beds, there are a number of major disadvantages associated with the use of conventional CBA tools. For example, the number of CBA tools being run at any one time significantly increases the number of connections in the drill string that need to be made-up, broken out and inspected on a regular basis. The CBA tools themselves, though simple in design, have a relatively high cost not only in terms of their manufacture but also in terms of their transportation costs, maintenance costs, and inspection costs. The unit length of the subs can also be problematic as they increase the overall length of a stand of drill pipe (i.e., 3×drill pipe sections coupled together) being racked back in the drilling derrick when pulling out of the borehole. In addition, the radial extent of which the paddle-type or bladed central section is necessarily limited, such that in use their proximity to the low side cuttings beds and thus efficacy is also limited.

SUMMARY

Aspects of the present disclosure relate to a drill cuttings agitator for agitating drill cuttings in a borehole, a downhole tool comprising one or more of the drill cuttings agitators, a downhole system comprising one or more of the drill cuttings agitators and/or downhole tools, a method of agitating drill cuttings using the drill cuttings agitator, downhole tool and/or downhole system, and a method of installing a drill cuttings agitator on a tubular body.

According to a first aspect, there is provided a drill cuttings agitator for agitating drill cuttings in a borehole, the drill cuttings agitator comprising:

an elastomeric sleeve; and one or more agitator members extending radially from the elastomeric sleeve.

In use, the drill cuttings agitator is configured for mounting on and/or around a tubular body, in particular a drill pipe forming part of a drill string, the drill cuttings agitator mounted on the tubular body such that the drill cuttings agitator will rotate with rotation of the tubular body, e.g. drill pipe. Rotation of the drill cuttings agitator agitates drill cuttings in the borehole, thereby inhibiting the formation of drill cuttings beds and/or facilitating the transportation of drill cuttings from the borebole.

The drill cuttings agitator may be reconfigurable between a first configuration in which the elastomeric sleeve has a first inner diameter and a second configuration in which the elastomeric sleeve has a second, larger, inner diameter.

In use, reconfiguration of the drill cuttings agitator between the first configuration and the second configuration facilitates location of the drill cuttings agitator on the tubular body. For example, where the tubular body comprises or takes the form of a drill pipe, reconfiguration of the drill cuttings agitator between the first configuration and the second configuration permits the drill cuttings agitator to traverse the tool joint connection portion(s) of the drill pipe.

The present drill cuttings agitator provides a number of significant benefits over conventional tools and equipment.

For example, the drill cuttings agitator obviates the requirement for separate subs, and their associated manufacturing, maintenance costs, and/or inspection costs. The ability to provide drill cuttings agitation without the use of bespoke subs-which, amongst other things, must be manufactured using thick wall metal tubing and produced to a suitable degree of strength and tolerance so that they can be safely incorporated into the drill string-means that the drill cuttings agitator can be provided at lower manufacturing and/or inspection cost than conventional CBA tools.

The relatively lightweight and/or compact construction of the drill cuttings agitator may provide significant benefits in terms of transportation costs in comparison of conventional CBA tools, which may for example be 10 times longer and/or 50 to 100 times heavier per unit.

The ability to provide drill cuttings agitation without the use of bespoke subs may also obviate the requirement to hold extensive inventory of sub-based tools on site, and the associated transportation costs to site and storage space on site.

Moreover, as the drill cuttings agitator does not rely on the provision of a bespoke sub, the drill cuttings agitator may also permit the operator to adapt to the conditions experienced in a given borehole more effectively than with conventional CBA tools, since the number and/or placement of the drill cuttings agitators on the drill string can be selected by the operator on site.

As described above, the number of CBA tools being run at any one time significantly increases the number of connections in the drill string that need to be made-up, broken out and inspected on a regular basis. The unit length of the subs can also be problematic as they increase the overall length of the stands of drill pipe (i.e., 3 drill pipe sections coupled together) being racked back in the drilling derrick when pulling out of the borehole.

Thus, the ability to provide drill cuttings agitation without the use of bespoke subs may also obviate the time, labour and/or complexities associated with making and breaking connections, but also the risks associated with failure of the sub or its connections to the adjacent sections of drill pipe.

In particular embodiments, the elastomeric sleeve and the one or more agitator members may be integrally formed and/or may define a single piece, unitary or substantially unitary construction.

Alternatively, the elastomeric sleeve and the one or more agitator members may be formed from separate components. Where the elastomeric sleeve and the one or more agitator members may be formed from separate components, the agitator members may be coupled to and/or configured for coupling to the elastomeric sleeve. For example, the one or more agitator members may be bonded, e.g. adhesively bonded, to the elastomeric sleeve. Alternatively or additionally, the one or more agitator members may be moulded, e.g. over-moulded, onto the elastomeric sleeve.

The elastomeric sleeve may be configured, e.g. dimensioned and/or shaped, for location on and/or circumferentially around the outside, e.g. outer circumferential surface of, the tubular body. The elastomeric sleeve may be annular. The elastomeric sleeve may be configured to circumscribe the tubular body. The elastomeric sleeve may be configured to be concentric with the tubular body. The elastomeric sleeve may be moulded.

As described above, the drill cuttings agitator may be reconfigurable between a first configuration in which the elastomeric sleeve has a first inner diameter and a second configuration in which the elastomeric sleeve has a second, larger, inner diameter.

The elastomeric sleeve may be elastically deformable, to facilitate reconfiguration of the drill cuttings agitator from the first configuration to the second configuration and vice versa. In particular embodiments, the elastomeric sleeve may be elastically deformable by at least 30%, i.e. the elastomeric sleeve may be formed of a material and/or constructed so that the elastomeric sleeve is capable of being stretched by 30% or more.

In the first configuration, the elastomeric sleeve may define an inner diameter which is smaller than or equal to the outer diameter of the tubular body. The elastomeric sleeve may be configured to define an interference fit with the tubular body.

The elastomeric sleeve may be constructed from an elastomeric material. The elastomeric material may comprise or take the form of rubber, e.g. HNBR rubber. The elastomeric material may comprise or take the form of urethane.

The elastomeric sleeve may be configured, e.g. shaped and/or dimensioned to deflect fluid flow, thereby aiding the agitation of the drill cuttings.

As described above, the drill cuttings agitator comprises one or more agitator members.

The agitator members may comprise or take the form of paddles.

In use, rotation of the drill cuttings agitator engages the paddles with the drill cuttings and/or generates turbulence in the fluid in the borehole, thereby agitating the drill cuttings so as to inhibit the formation of drill cuttings beds and/or facilitate the transportation of the drill cuttings from the borehole, e.g. by the borehole fluid circulation system.

In particular embodiments, the drill cuttings agitator comprises a plurality of agitator members, e.g. 2, 3, 4, 5, 6 or more agitator members.

The plurality of agitator members may be circumferentially arranged and/or spaced around the elastomeric sleeve.

At least one of the agitator members may be flexible. In particular embodiments, all of the agitator members are flexible.

Beneficially, the flexible nature of the one or more agitator members may allow for extended sweep radius, providing more effective and/or efficient agitation of the low side cuttings beds. For example, the drill cuttings agitator may be configured so that one or more of the agitator members engages the wall of the borehole.

One or more of the agitator members may be elongate, e.g. may have a longer length than width.

One or more of the agitator members may be parallel or substantially parallel with a longitudinal axis of the elastomeric sleeve.

One or more of the agitator members may extend circumferentially. One or more of the agitator members may extend further circumferentially than radially.

One or more of the agitator members may be curved.

One or more of the agitator members may be straight.

However, it will be understood that the agitator members may have other forms. For example, the one or more rib portions may alternatively extend at least partially circumferentially around the elastomeric sleeve, in particular but not exclusively in a spiral configuration or the like.

One or more of the agitator members, and in particular embodiments all of the agitator members, may be constructed from an elastomeric material. The elastomeric material may comprise or take the form of rubber, e.g. HNBR rubber. The elastomeric material may comprise or take the form of urethane.

The relative softness and/or low density of the one or more agitator members may mean that any loss of material from the agitator members does not inhibit the drilling process, with for example any material being circulated out of the borehole; in contrast to conventional tools which require metallic components which cannot be easily drilled using conventional drill bits and so risk leaving "junk" in the borehole. Moreover, the relatively low coefficient of friction of the material used to form the drill cuttings agitator reduces both rotational and linear friction, amongst other things improving drilling efficiency.

The elastomeric sleeve may comprise one or more slots. The slots may extend axially. The slots may be circumferentially arranged and/or spaced around the elastomeric sleeve.

The slots may be disposed between and/or defined by the agitator members.

At least one of the slots may extend the length of the elastomeric sleeve.

In some embodiments, all of the slots may extend the length of the elastomeric sleeve.

In other embodiments, at least one of the slots may comprise or take the form of a blind slot, i.e. the slot may not extend the length of the elastomeric sleeve. A blind end surface of the blind slot may extend laterally to the slot, e.g. the blind end surface may be perpendicular to the slot.

In some embodiments, all of the slots may define blind slots.

The one or more slots may be configured, e.g. shaped and/or dimensioned to deflect fluid flow, thereby aiding the agitation of the drill cuttings and/or preventing blockage of the slots. The one or more slot may be tapered, e.g. the radial depth of the slot may vary axially along the slot.

Alternatively or additionally, at least one of the slots may be configured, e.g. shaped and/or dimensioned, to engage with respective biased member for installing the agitator on the tubular body.

The drill cuttings agitator may comprise a tapered end portion.

The elastomeric sleeve may comprise one or more end portions. At least of the end portions may be tapered, e.g. the radial depth of the elastomeric sleeve may vary axially along the end portion of the elastomeric sleeve.

An end portion of at least one of the agitator members may be tapered, e.g. a radial depth of the agitator member may vary axially along the end portion of the agitator member.

Beneficially, the tapered end portion of the elastomeric sleeve and/or the at least one agitator member may deflect fluid passing over the elastomeric sleeve, aiding the agitation of the drill cuttings.

The drill cuttings agitator may be configured to contain an adhesive for securing the drill cuttings agitator to the tubular body.

The drill cuttings agitator may comprise a container for receiving and/or storing an adhesive. The container may be configured to releasably store an adhesive. The adhesive may be configured for bonding the elastomeric sleeve to the tubular body.

The container may be sealed. The container may be frangible, breakable and/or degradable. The container may be configured to break when the elastomeric sleeve is in its second configuration. The container may be configured to releasably store the adhesive. The container may be less elastically deformable than the elastomeric sleeve. The container may be configured to release the adhesive when the elastomeric sleeve is in its second configuration. The container may be configured to release the adhesive when the drill cuttings agitator is being installed on the tubular body. The container may be configured to have a breaking diameter, e.g. a diameter at which the container will fracture rather than deform. The breaking diameter may be less than an external diameter of a connection upset of the tubular body.

The container may comprise and/or be formed of glass or plastic.

The adhesive may be configured to activate and/or cure, when the adhesive is released from the container. The adhesive may be configured to activate and/or cure when exposed to air The container may be annular. The container may be comprised or located in an inner surface of the elastomeric sleeve. The elastomeric sleeve may comprise a recess configured to receiving the container. The recess may be annular. The recess may be defined in the inner surface of the elastomeric.

The elastomeric sleeve may comprise one or more grooves for communicating the adhesive. The grooves may be on the internal surface of the elastomeric sleeve. The grooves may extend axially. The grooves may intersect the recess. The grooves may distribute the adhesive across the inner surface of the elastomeric sleeve. The grooves may be capillary grooves. The elastomeric sleeve may comprise a plurality of grooves. The plurality of grooves may be circumferentially spaced around the elastomeric sleeve.

According to a second aspect, there is provided a downhole tool comprising:

a tubular body; and one or more of the drilling cuttings agitators of the first aspect mounted on the tubular body.

In use, the one or more drill cuttings agitators are configured for mounting on and/or around the tubular body, in particular a drill pipe forming part of a drill string, the drill cuttings agitator mounted on the tubular body such that the drill cuttings agitator will rotate with rotation of the tubular body, e.g. drill pipe. Rotation of drill cuttings agitator agitates drill cuttings in the borehole, thereby inhibiting the formation of drill cuttings beds and/or facilitating the transportation of drill cuttings from the borebole.

As described above with respect to the first aspect, the drill cuttings agitator beneficially obviates the requirement for separate subs.

The tubular body may comprise or take the form of a drill pipe.

The downhole tool may comprise a connection arrangement. The connection arrangement may be formed or otherwise disposed at respective ends of the tubular body. The connection arrangement may facilitate connection of the downhole tool to adjacent components of a downhole tool string, in particular a drill string. The connection arrangement may comprise a threaded pin connector. The threaded pin connector may be provided at a downhole end of the tubular body. Alternatively or additionally, the threaded pin connector may be provided at an uphole end of the tubular body. The connection arrangement may comprise a threaded box connector. The threaded box connector may be provided at an uphole end of the tubular body. Alternatively or additionally, the threaded box connector may be provided at a downhole end of the tubular body. The threaded pin and box connectors may take the form of API (American Petroleum Institute) connectors. Alternatively, the connection arrangement may take any other suitable form, such as premium connectors or the like.

The tubular body may comprise one or more connection upsets. For example, where the tubular body takes the form of a drill pipe, the connection upsets may take the form of tool joint connection upsets of the drill pipe. The elastomeric sleeve may be mounted on the body above or below, e.g. axially either side of, the connection upsets.

The elastomeric sleeve may be secured to the tubular body. The elastomeric sleeve may be bonded, e.g. adhesively bonded, to the tubular body.

The tubular body may comprise one or more recesses. The one or more recesses may be configured to receive one or more drill cuttings agitator of the first aspect. One or more end faces of the recess may define thrust bearing surfaces for the elastomeric sleeve of the drill cuttings agitator.

The elastomeric sleeve may be directly mounted on the body.

The downhole tool may comprise a plurality of the drill cuttings agitators. Where the downhole tool comprises a drill cuttings agitators, the drill cuttings agitators may be axially spaced along the tubular body.

According to a third aspect, there is provided a downhole system for agitating drill cuttings, the system comprising one or more downhole tools according to the second aspect.

According to a fourth aspect, there is provided a method of agitating a cuttings bed in a borehole using the cuttings agitator of the first aspect, the downhole tool of the second aspect or the downhole system of the third aspect.

Beneficially, the number of cuttings agitators run on a drill string at any one time does not have any impact on the number of connections in the drill string. The need to make up, break out and inspect the additional connections required for sub based CBA tools may be eliminated.

The method may comprise rotating the cuttings agitator in the borehole. The cuttings agitator may be rotated in the vicinity of the cuttings bed. Rotating the cuttings agitator in the borehole may involve rotating the downhole system in the borehole.

The borehole may be a high-angle borehole. The cuttings bed to be agitated may be located on a low side of the high-angle borehole.

The plurality of extended agitator members may contact the low side of the high-angle borehole. The plurality of extended agitator members may contact the cuttings bed.

The plurality of broad agitator members may be adjacent the low side of a high-angle borehole. The plurality of broad agitator members may generate turbulence close to the cuttings bed.

According to a fifth aspect, there is provided a method of installing a drill cuttings agitator according to the first aspect onto a tubular body, the method comprising:

- providing a drill cuttings agitator according to the first aspect;
- providing a tubular body,
- reconfiguring the drill cuttings agitator from a first configuration in which the elastomeric sleeve defines the first inner diameter to the second configuration in which the elastomeric sleeve defines its second, larger, inner diameter, to facilitate location of the drill cuttings agitator onto the tubular body; and
- reconfiguring the drill cuttings agitator from the second configuration to the first configuration to secure the drill cuttings agitator to the tubular body.

The method may be carried out on site, e.g. on a rig floor.

The method may comprise reconfiguring the drill cuttings agitator from its first configuration in which the elastomeric sleeve defines the first inner diameter to its second configuration in which the elastomeric sleeve defines its second, larger, inner diameter.

The method may comprise relatively axially moving the elastomeric sleeve and the tubular body with the elastomeric sleeve arranged around, e.g. concentrically around, the tubular body. When the elastomeric sleeve is around the tool connection joint upset the drill cuttings agitator may be deformed to its second configuration in which the elastomeric sleeve defines its second, larger, inner diameter.

When the elastomeric sleeve is around the body the elastomeric sleeve may be contracted by the bias of the elastomeric sleeve towards its contracted configuration.

The method may comprise passing the elastomeric sleeve in its expanded configuration over the tool joint connection upset. Alternatively, the method may comprise passing the tool joint connection upset through the elastomeric sleeve in its expanded configuration.

The installation of the elastomeric cuttings bed agitator sleeve may be achieved by means of a forcing cone. The forcing cone may deform the elastomeric sleeve from its contracted configuration to its expanded configuration.

The method may comprise pushing the elastomeric sleeve up the forcing cone. The method may comprise pushing the elastomeric sleeve over the tool joint upset. The method may comprise pushing the elastomeric sleeve on to the body above or below, e.g. axially either side of, the tool joint upset. The method may comprise pushing the elastomeric sleeve with a finger arrangement.

Alternatively, the method may comprise pushing the forcing cone through the elastomeric sleeve. The method may comprise pushing the tool joint upset thought the elastomeric sleeve. The method may comprise pushing the body through the elastomeric sleeve until the elastomeric sleeve is above or below, e.g. either axial side of, the tool joint upset. The method may comprise holding the elastomeric sleeve with a finger arrangement.

The finger arrangement may be a finger collet or finger plate assembly tool. The finger arrangement may comprise a radial array of biased members. The biased members may be fingers, followers, dogs, lugs, etc. The biased members may be spring loaded, hydraulic and/or pneumatically loaded. The biased members may be biased into contact with the drill cuttings agitator.

The biased members may engage the elastomeric sleeve around its circumference. The biased members may engage the elastomeric sleeve at different axial locations. The biased members may engage the blind slots. The biased members may engage the blind ends of the blind slots.

The method may comprise reconfiguring the elastomeric sleeve from its expanded configuration toward its contracted configuration to mount the elastomeric sleeve on the body. The bias of the elastomeric sleeve may reconfigure the elastomeric sleeve from its expanded configuration toward its contracted configuration. The elastomeric sleeve may be mounted on the body in a partially-deformed configuration. The body may prevent the elastomeric sleeve from resuming its contracted configuration. The elastomeric sleeve may shrink, e.g. contract, into place on the body of the drill pipe in a gripping relationship between the internal surface of the elastomeric sleeve and the external surface of the body.

The method may comprise conforming the biased members to the elastomeric sleeve as it expands and contracts.

The method may comprise releasing adhesive between drill cuttings agitator and the tubular body. The method may comprise breaking a container in which the adhesive is stored. Breaking the container may comprise expanding the container over the forcing cone and/or connection upset beyond the elastic limit of the container. Breaking the container may comprise expanding the container over the forcing cone and/or connection upset to its breaking diameter.

According to a sixth aspect there is provided an assembly for installing a drill cuttings agitator according to the first aspect onto a tubular body, the assembly comprising a forcing cone configured for reconfiguring the drill cuttings agitator from a first configuration in which the elastomeric sleeve defines the first inner diameter to the second configuration in which the elastomeric sleeve defines its second, larger, inner diameter, to facilitate location of the drill cuttings agitator onto the tubular body.

The forcing cone may be comprised in and/or connectable to the tubular body.

The assembly may comprise a plate arrangement. The plate arrangement may comprise an aperture. The aperture may be configured to receive the tubular body.

The assembly may comprise a finger arrangement. The finger arrangement may be part of and/or mounted on the plate arrangement. The finger arrangement may be a finger collet or finger plate assembly tool.

The finger arrangement may comprise a radial array of biased members. The biased members may be arranged around the aperture. The biased members may be fingers, followers, dogs, lugs, etc. The biased members may be spring loaded, hydraulic and/or pneumatically loaded. The biased members may be biased inwardly. The biased members may be configured to conform to the elastomeric sleeve as it expands and contracts during installation. The biased members may be releasable, e.g. the bias of the biased members may be removed and/or reversed.

The assembly may comprise a container for receiving and/or storing an adhesive. The adhesive may be configured to bond the elastomeric sleeve to the tubular body. The container may be sealed. The container may be frangible. The adhesive may be configured to activate, cure, etc. when the adhesive is released from the container. The adhesive may be configured to release a bonding agent when exposed to air. The container may be less elastically deformable than the elastomeric sleeve. The container may be configured to have a breaking diameter, e.g. a diameter at which the container will fracture rather than deform. The breaking diameter may be less than an external diameter of a connection upset of the tubular body.

The container may be annular. The container may be configured to be positioned in the elastomeric sleeve.

The invention is defined by the appended claims. However, for the purposes of the present disclosure it will be understood that any of the features defined above or described below may be utilised in isolation or in combination. For example, features described above in relation to one of the above aspects or below in relation to the detailed description below may be utilised in any other aspect, or together form a new aspect.

BRIEF DESCRIPTION OF THE DRAWINGS

These and other aspects will now be described by way of example with reference to the accompanying drawings, of which.

DETAILED DESCRIPTION OF THE DRAWINGS

Figure 1:
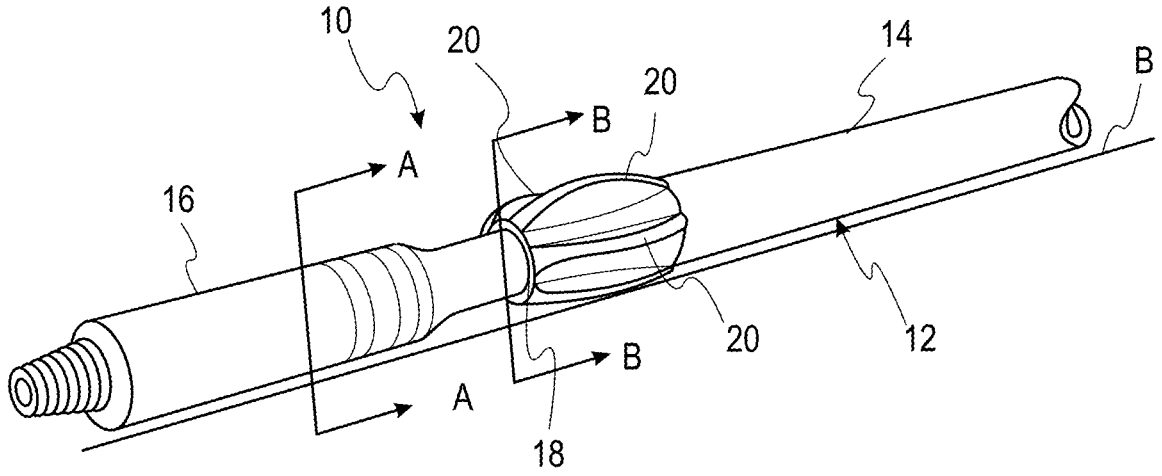
FIG. 1 shows a perspective view of a drill cuttings agitator installed on a tubular body.

Referring first to FIG. 1 of the accompanying drawings, there is shown a drill cuttings agitator 10 for agitating drill cuttings in a borehole B.

As will be described further below, the drill cuttings agitator 10 is installed on a tubular body, generally denoted 12. As shown in FIG. 1, the tubular body 12 takes the form of a section of drill pipe, i.e. a section of thick wall tubing forming part of a drill string for drilling the borehole B. The illustrated drill cuttings agitator 10 is disposed on and around a central portion 14 of the tubular body 12 and between connection upset portions 16 used to couple the tubular body 12 to adjacent sections of the drill string.

In use, the drill cuttings agitator 10 is configured for mounting on and around the tubular body 12, the drill cuttings agitator 10 mounted on the tubular body 12 such that the drill cuttings agitator 10 will rotate with rotation of the tubular body 12. Rotation of the drill cuttings agitator 10 agitates drill cuttings in the borehole B, thereby inhibiting the formation of drill cuttings beds and/or facilitating the transportation of drill cuttings from the borehole B.

The drill cuttings agitator 10 provides a number of significant benefits over conventional tools and equipment.

For example, the drill cuttings agitator 10 obviates the requirement for separate subs, and their associated manufacturing, maintenance costs, and/or inspection costs. The ability to provide drill cuttings agitation without the use of bespoke subs-which, amongst other things, must be manufactured using thick wall metal tubing and produced to a suitable degree of strength and tolerance so that they can be safely incorporated into the drill string-means that the drill cuttings agitator 10 can be provided at lower manufacturing and/or inspection cost than conventional CBA tools.

The relatively lightweight and/or compact construction of the drill cuttings agitator 10 provide significant benefits in terms of transportation costs in comparison of conventional CBA tools, which may for example be 10 times longer and/or 50 to 100 times heavier per unit.

The ability to provide drill cuttings agitation without the use of bespoke subs may also obviate the requirement to hold extensive inventory of sub-based tools on site, and the associated transportation costs to site and storage space on site.

Moreover, as the drill cuttings agitator 10 does not rely on the provision of a bespoke sub, the drill cuttings agitator 10 also permits the operator to adapt to the conditions experienced in a given borehole B more effectively than with conventional CBA tools since the number and/or placement of the drill cuttings agitators on the drill string can be selected by the operator on site.

As described above, the number of CBA tools being run at any one time significantly increases the number of connections in the drill string that need to be made-up, broken out and inspected on a regular basis. The unit length of the subs can also be problematic as they increase the overall length of the stands of drill pipe (i.e., 3 drill pipe sections coupled together) being racked back in the drilling derrick when pulling out of the borehole.

Thus, the ability to provide drill cuttings agitation without the use of bespoke subs may also obviate the time, labour and/or complexities associated with making and breaking connections, but also the risks associated with failure of the sub or its connections to the adjacent sections of drill pipe.

As shown in FIG. 1, the drill cuttings agitator 10 comprises an elastomeric sleeve 18 and a plurality of agitator members 20 which extend radially from the elastomeric sleeve 18. In the illustrated drill cuttings agitator 10, the agitator member 20 take the form of paddles.

In use, rotation of the drill cuttings agitator 10 engages the agitator members 20 with the drill cuttings and/or generates turbulence in the fluid in the borehole B, thereby agitating the drill cuttings so as to inhibit the formation of drill cuttings beds and/or facilitate the transportation of the drill cuttings from the borehole B, e.g. using the borehole's fluid circulation system.

In the illustrated drill cuttings agitator 10, the elastomeric sleeve 18 and the agitator members 20 are integrally formed.

Figure 2A:
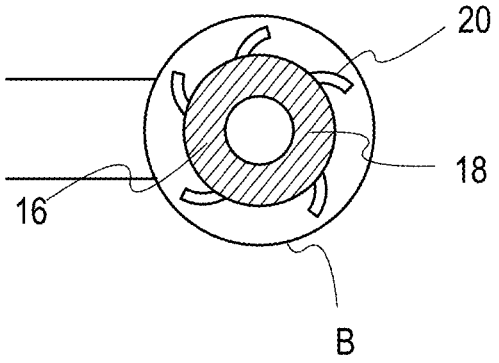
FIG. 2*a* shows cross-sectional view A-A of the drill cuttings agitator and tubular body shown in FIG. 1.
Figure 2B:
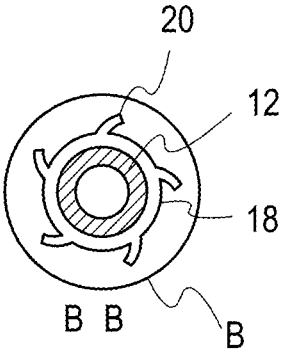
FIG. 2*b* shows cross-sectional view B-B of the drill cuttings agitator and drill pipe shown in FIG. 1.

As shown in FIG. 1, and referring now also to FIGS. 2*a* and 2*b* of the accompanying drawings, it can be seen that the elastomeric sleeve 18 is generally tubular in construction having a throughbore 22 extending therethrough.

In the illustrated drill cutting agitator 10, the elastomeric sleeve 18 is constructed from HNBR rubber, the elastomeric sleeve 18 being elastically deformable to facilitate reconfiguration of the drill cuttings agitator 10 from the first configuration to the second configuration and vice versa.

In use, elastic expansion of the elastomeric sleeve 18 increases its inner diameter from the first inner diameter when the drill cuttings agitator 10 defines the first configuration) to the second, larger, inner diameter when the drill cuttings agitator 10 defines the second configuration, the second, larger, inner diameter permitting the elastomeric sleeve 18 to pass over the upset portion 16 of the tubular body 12. The drill cuttings agitator 10, by virtue of its elastomeric material construction of the sleeve 18, is biased toward the first configuration and so contracts onto the smaller outer diameter central portion 14 of the tubular body 12, thereby securing the sleeve 18 on the tubular body 12. In the illustrated drill cuttings agitator 10, the first inner diameter of the sleeve 18 is smaller than the outer diameter of the central portion 14 such that the sleeve 18 defines an interference fit with the tubular body 12.

As noted above, in the illustrated drill cuttings agitator 10 the elastomeric sleeve 18 and the agitator members 20 are integrally formed, the agitator members 20 also being formed of an elastomeric material in the form of HNBR rubber.

The agitator members 20 are flexible, the drill cuttings agitator 10 configured so that the agitator members 20 engage the wall of the borehole B.

Beneficially, the flexible nature of the agitator members 20 allows for an extended sweep radius, providing more effective and/or efficient agitation of the drill cuttings.

The flexible nature of the agitator members 20 reduces the bending stresses at their roots, e.g. at the connection point between the agitator members 20 and the elastomeric sleeve 18. The possibility of fatigue and breakage of the extended flexible agitator members 20 is substantially reduced. However, should breakage occur and part of the agitator members 20 is lost in the borehole B, the added advantage of using elastomeric materials is that the density of this type of material is relatively low, meaning that it will not inhibit the drilling process and can be easily circulated out of the borehole B.

FIGS. 2*a* and 2*b* show the relationship of the extended flexible agitator members 20 to the wall 22 of the borehole B, in particular to the low side of the borehole B. As shown, the upset 16 contacts the low side of the borehole B, supporting the weight of the tubular body 12. The agitator members 20 on the elastomeric sleeve 18 flex outwardly beyond the outer surface of the upset 16 to contact the wall of the borehole B. The agitator members 20 are able to sweep beyond the upset 16, providing enhanced sweeping of the low side of the wall 22 of the borehole B by physically contacting and agitating low side cuttings beds.

Various modifications may be made without departing from the scope of the invention as defined in the claims.

Figure 3:
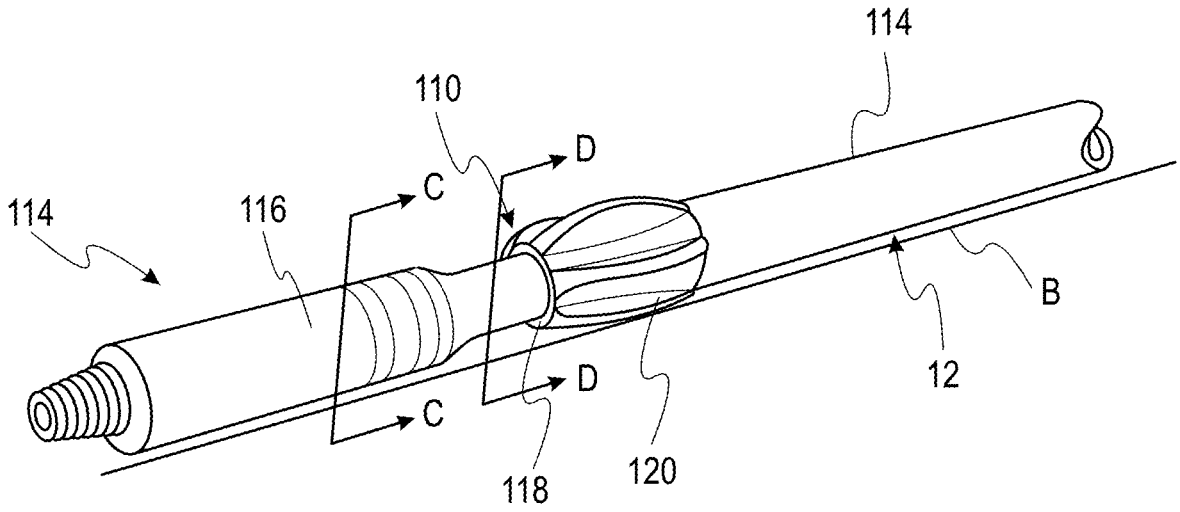
FIG. 3 shows a perspective view of another drill cuttings agitator installed on a tubular body.
Figure 4A:
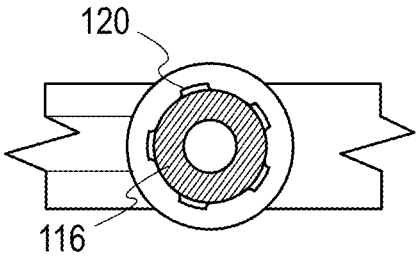
FIG. 4*a* shows cross-sectional view C-C of the drill cuttings agitator and drill pipe shown in FIG. 3.
Figure 4B:
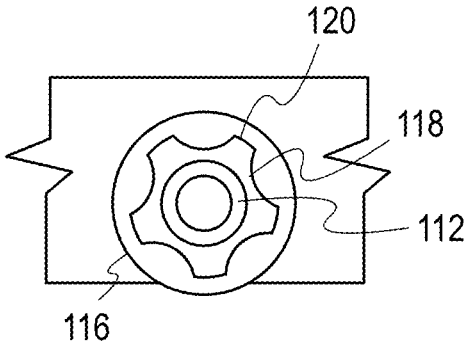
FIG. 4*b* shows cross-sectional view D-D of the drill cuttings agitator and drill pipe shown in FIG. 3.

For example, referring now to FIGS. 3, 4*a* and 4*b* of the accompanying drawings, there is shown an alternative drill cuttings agitator 110 installed on a tubular body, generally denoted 112. Like the tubular body 12 described above, the tubular body 112 takes the form of a section of drill pipe, i.e. a section of thick wall tubing forming part of a drill string for drilling the borehole B. The illustrated drill cuttings agitator 110 is disposed on and around a central portion 114 of the tubular body 112 and between connection upset portions 116 used to couple the tubular body 112 to adjacent sections of the drill string.

The drill cuttings agitator 110 of FIG. 3 substantially corresponds to the drill cuttings agitator 10 of FIG. 1, except for the agitator members 120 which, as shown, are broader in profile and more rigid in comparison to the agitator members 120 of the drill cuttings agitator 10 shown in the FIG. 1. The agitator members 120 are robust and more in line with existing sub based CBA's. As shown, the broad agitator members 120 are circumferentially spaced around the elastomeric sleeve 118.

FIGS. 4*a* and 4*b* show the relationship of the agitator members 120 to the wall of the borehole B. As shown, the radial dimension of the broad agitator members 120 is close to or preferably less that the outer diameter of the upset 116. In this embodiment, the agitation members 120 may not contact the low side cuttings beds, but generate turbulence in fluid in the borehole B, which agitates the drill cuttings in the borehole B, thereby inhibiting the formation of drill cuttings beds and/or facilitating the transportation of drill cuttings from the borehole B.

FIGS. 5*a* to 5*d* show a method for installing a drill cuttings agitator 210 onto a tubular body 212. The drill cuttings agitator 210 may be a drill cuttings agitator 10 shown in FIG. 1, or a drill cuttings agitator 110 shown in FIG. 3.

Figure 5A:
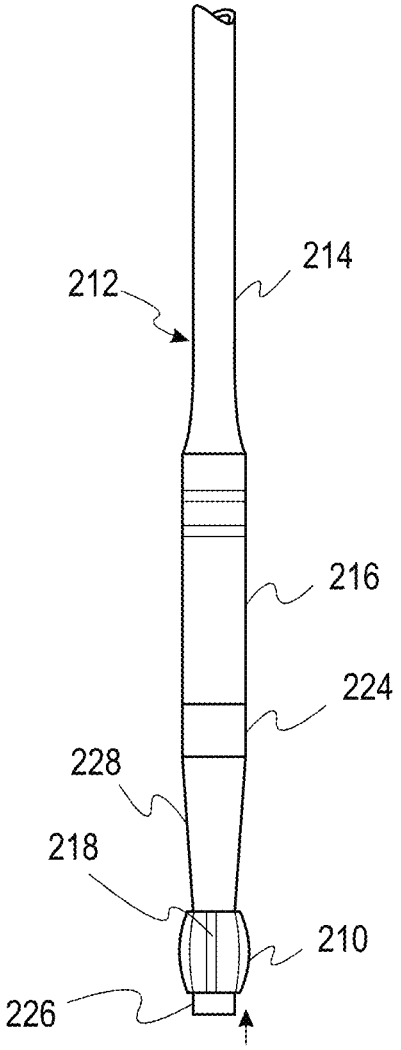
FIGS. 5*a* to 5*d* show a method for installing a drill cuttings agitator onto a tubular body.

As shown in FIG. 5*a*, the drill cuttings agitator 210 is positioned at an entry point, e.g. a narrower portion, of a forcing cone 224. In particular, FIG. 5*a* shows the elastomeric sleeve 218 installed on a parallel, e.g. constant diameter, feed section 226 of the forcing cone 224 prior to the elastomeric sleeve 218 being pushed up a tapered section 228, e.g. increasing diameter section, of the forcing cone 224.

Figure 5B:
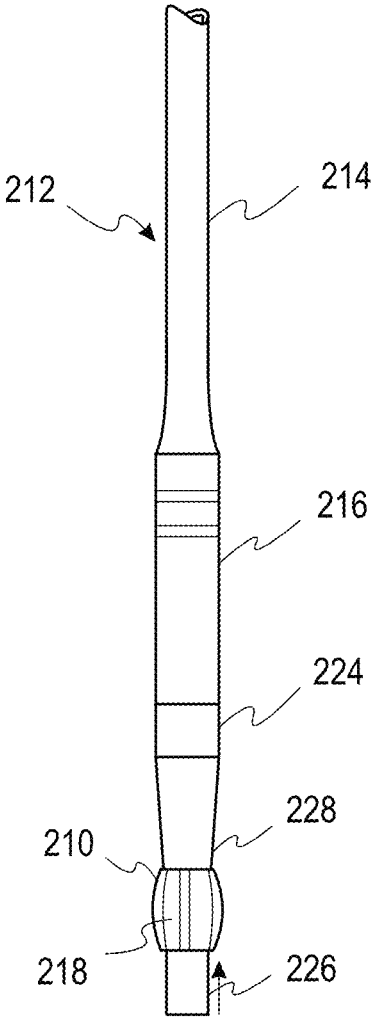

In FIG. 5*b*, the elastomeric sleeve 218 of the drill cuttings agitator 210 is partially expanded, having been pushed up the forcing cone 224. In particular, FIG. 5*b* shows the elastomeric sleeve 218 being pushed up the start of the tapered section 228 of the forcing cone 224.

Figure 5C:
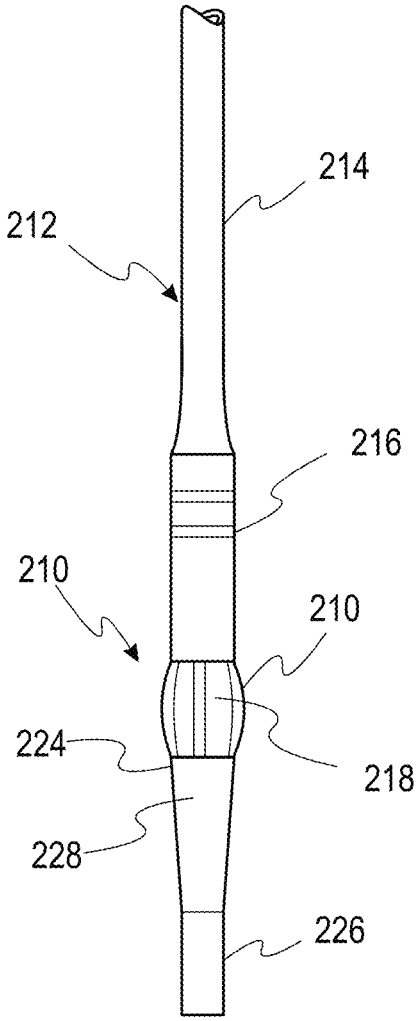

In FIG. 5*c*, the elastomeric sleeve 218 of the drill cuttings agitator 210 is fully expanded, having been pushed along upset portion 216. In particular, FIG. 5*c* shows the elastomeric sleeve 218 in its expanded configuration passing over the top of the tapered section 228 of the forcing cone 224 and onto the parallel section, e.g. constant diameter section, of the upset portion 216.

Figure 5D:
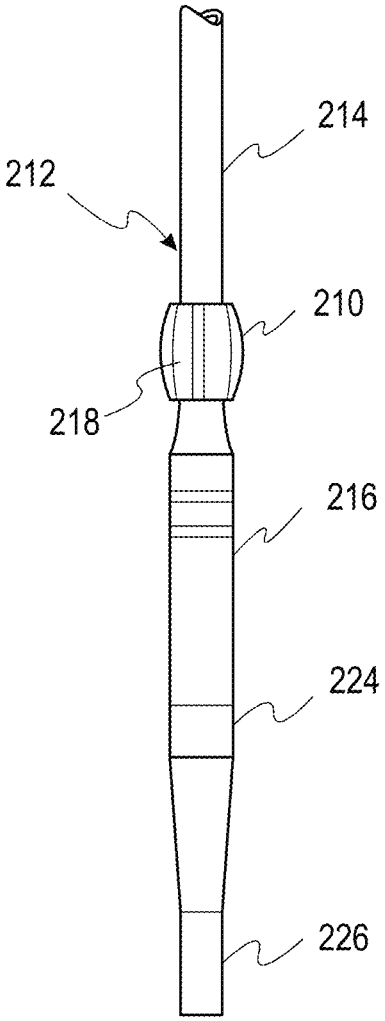

In FIG. 5*d*, the elastomeric sleeve 218 of the drill cuttings agitator 210 has contracted into place on the tubular body 212 above the upset portion 216. In particular, FIG. 5*d* shows the elastomeric sleeve 218 elastically contracted towards its contracted configuration, into its installed position in a gripping relationship with the central portion 214 of the tubular body 212.

The process of pushing the elastomeric sleeve 218 along the forcing cone 224 can be achieved by holding the tubular body 212 in a fixture (not shown) and pushing the elastomeric sleeve 218 along the tapered section 228 of the forcing cone 224 by means of a hydraulic ram (not shown) and a finger arrangement (not shown). The finger arrangement comprises a radial array of biased members. The members can be fingers or followers. The biased members can be spring loaded, hydraulic or pneumatically loaded. The finger arrangement can be a finger collet or a finger plate assembly tool.

As described above, various modifications may be made without departing from the scope of the invention as defined in the claims.

Figures 6A, 6B, 6C:
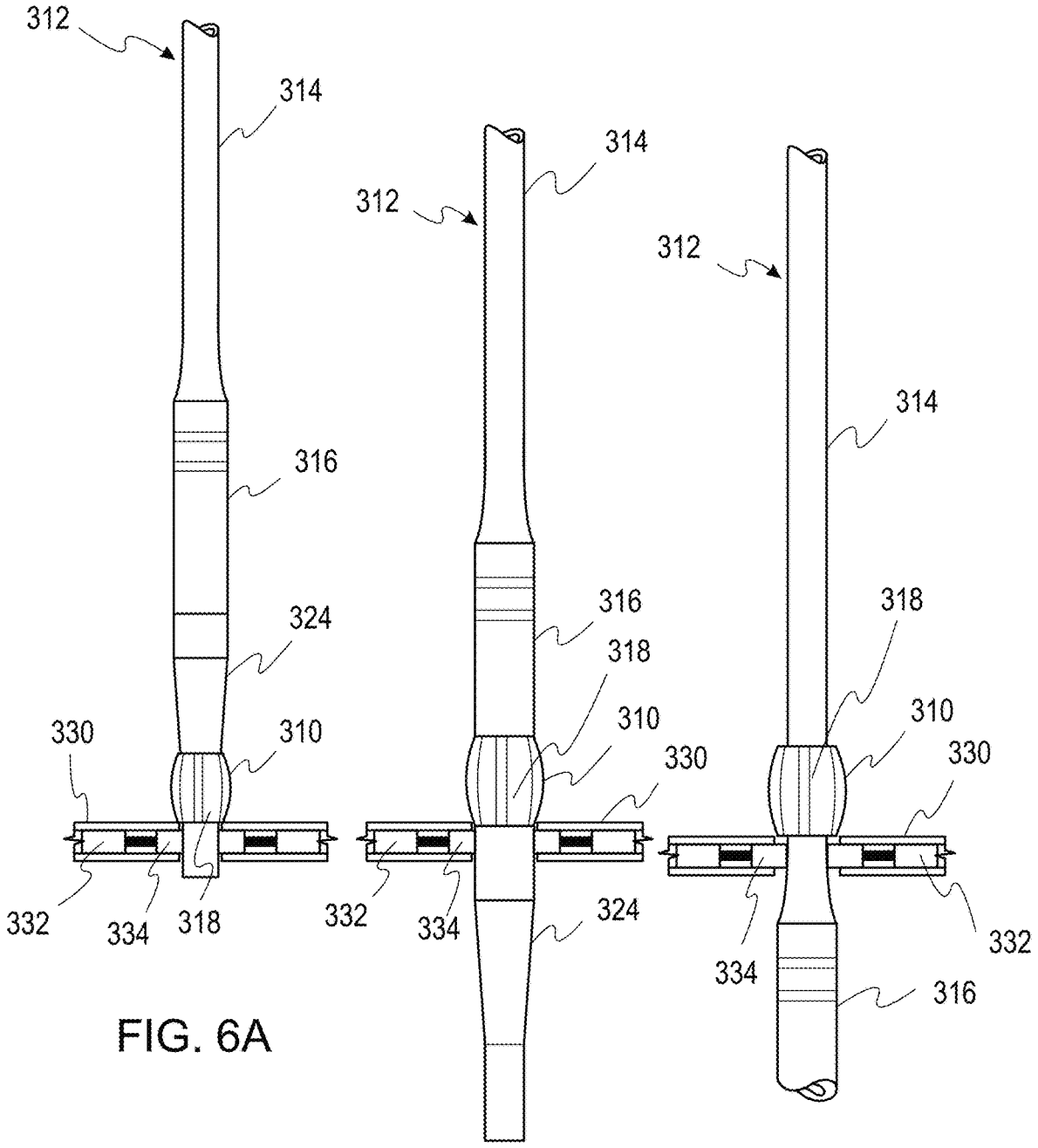
FIGS. 6*a* to 6*c* show another method for installing a drill cuttings agitator onto a tubular body.

For example, FIGS. 6*a* to 6*c* show another method for installing a drill cuttings agitator 310 onto a tubular body 312 The drill cuttings agitator 310 may be a drill cuttings agitator 10 shown in FIG. 1, or a drill cuttings agitator 110 shown in FIG. 3. The tubular body 312 and forcing cone 324 can be passed, pushed or lowered through the elastomeric sleeve 318. The elastomeric sleeve 318 can be located or standing on a plate assembly 330 with a radial array of biased members 332. The biased members 332 are pneumatically loaded fingers. In other installation systems, the biased members can be followers. In other installation systems, the biased members can be spring loaded or hydraulic.

FIGS. 6*a* to 6*c* show sequential stages of the drill cuttings agitator 310 being installed onto a body 312 of the drill pipe 314 by lowering the drill pipe 314 and forcing cone 324 through the elastomeric sleeve 318, which is standing on the plate assembly 330, with the radial array of biased members 332. The assembly plate 330 can be supported on a rotary table or mouse hole on a rig floor (not shown) for on-site installation.

The biased members 332 are hold the elastomeric sleeve 318 by means of a compressed air feed to pneumatic rams 334. The pressure of this compressed air feed defines the force applied to pneumatically load the biased members 332 and ensure that the biased members 332 remain in contact with the elastomeric sleeve 318 as it expands and contracts with movement relative to the parallel feed section 326 of the forcing cone 324, the tapered section 328, the upset portion 316, and the tubular body 312 above the upset portion 316 as the tubular body 312 is lowered through the elastomeric sleeve 318. In this way, the elastomeric sleeve 318 is installed onto the body 312 in an elastically contracted condition so that in its installed position the elastomeric sleeve 318 is in a gripping relationship with the tubular body 312.

In order to prevent the elastomeric sleeve 318 from collapsing or telescoping whilst it is being expanded during the installation process, the biased members 332 can engage the elastomeric sleeve 318 at a number of locations around its circumference and at various points along its length. The extent of collapse or telescoping will depend on the level of expansion, compressive loading and shore hardness of the elastomeric material used. The elastomeric sleeve 318 can comprise profiles or recesses (not shown) on its outer surface in which the biased members 332 engage to more evenly distribute the pushing or holding forces along the elastomeric sleeve 318 during installation as the elastomeric sleeve 318 expands and contracts into place on the body 312 of the drill pipe 314. The profiles or recesses are formed on the elastomeric sleeve 318 in a moulding process.

Figure 7A:
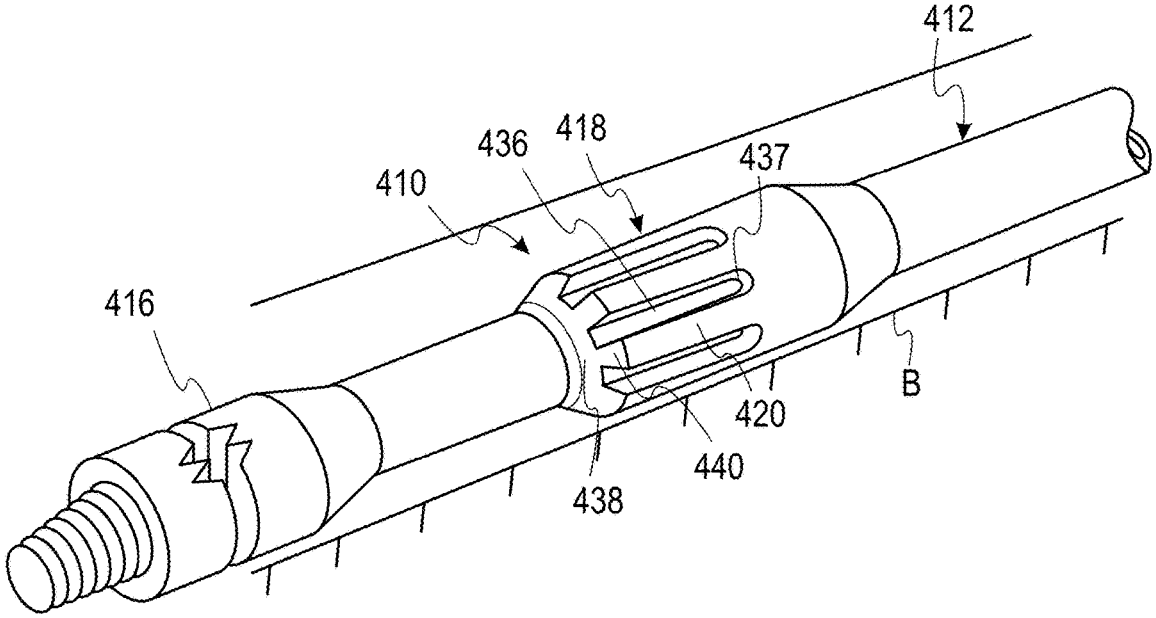
FIG. 7*a* shows a perspective view of another drill cuttings agitator installed on a tubular body.
Figure 7B:
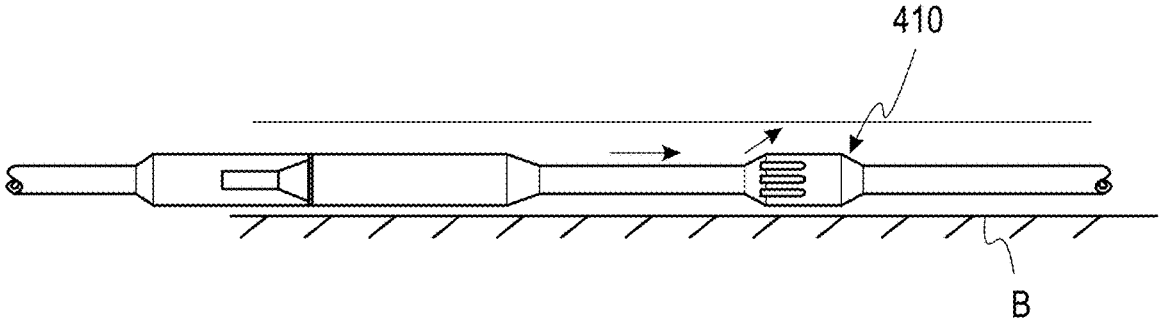
FIG. 7*b* shows a side view of the drill cutting agitator on FIG. 7*a* installed on the tubular body.

Referring now to FIGS. 7*a* and 7*b*, there is shown an alternative drill cuttings agitator 410 installed on a tubular body 412. Like the tubular body 12 described above, the tubular body 412 takes the form of a section of drill pipe, i.e. a section of thick wall tubing forming part of a drill string for drilling the borehole B. The illustrated drill cuttings agitator 410 is disposed on and around a central portion of the tubular body 412 and between connection upset portions 416 used to couple the tubular body 412 to adjacent sections of the drill string.

The drill cuttings agitator 410 of FIGS. 7*a* and 7*b* substantially corresponds to the drill cuttings agitator 10 of FIG. 1, except for the agitator members 420. The agitator members 420 define a plurality of blind slots 436 between them. As shown, the agitator members 420 and blind slots 436 alternate circumferentially around the elastomeric sleeve 418. The blind slots 436 extend axially along part of the elastomeric sleeve 418. The biased members 332 shown in FIGS. 6*a* to 6*c* can engage blind ends 437 of the blind slots 436 to hold the elastomeric sleeve 418 during installation of the elastomeric sleeve onto the tubular body 412.

Also shown in FIGS. 7*a* and 7*b*, the elastomeric sleeve comprises a tapered end portion 438. The agitator members 420 also comprise tapered end portions 440. The tapered shape deflects fluid passing over the elastomeric sleeve away from the elastomeric sleeve. The deflected fluid path is shown by the arrows in FIG. 7*b*. The deflected fluid can aid in agitating the drill cuttings.

Figure 8:
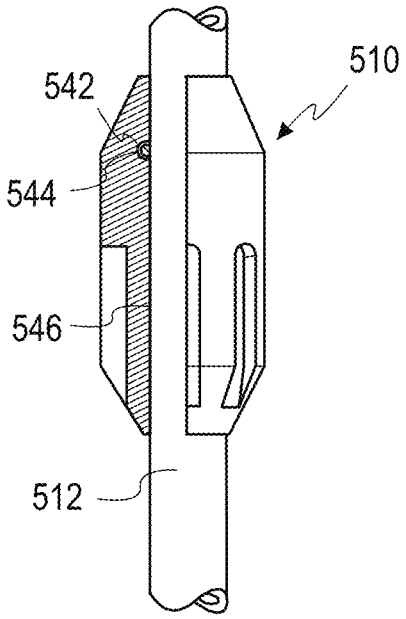
FIG. 8 shows a side view of another drill cuttings agitator installed on a tubular body.

Referring now to FIG. 8, there is shown an alternative drill cuttings agitator 510 installed on a tubular body 512. Like the tubular body 12 described above, the tubular body 512 takes the form of a section of drill pipe, i.e. a section of thick wall tubing forming part of a drill string for drilling the borehole.

Figure 9:
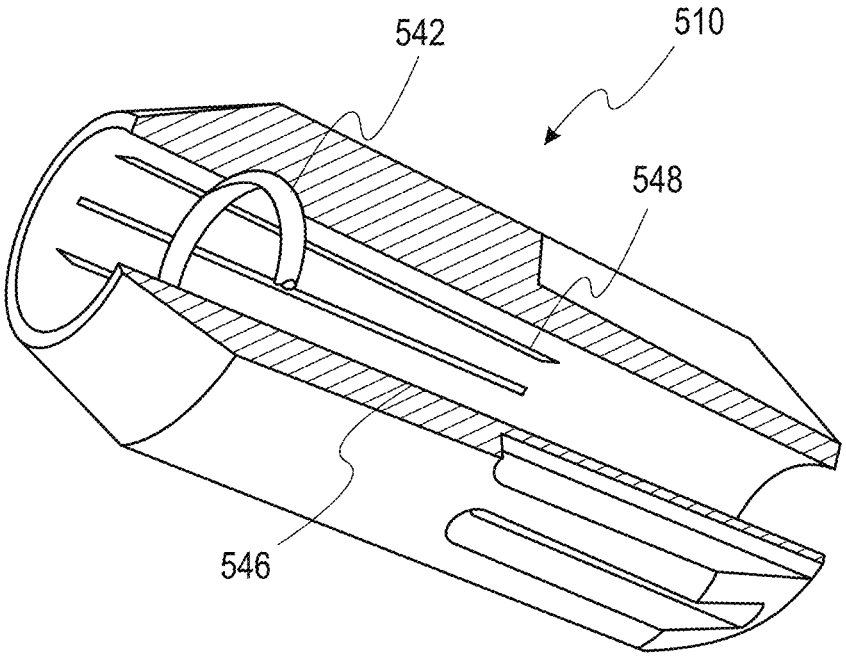
FIG. 9 shows a perspective sectional view of the drill cuttings agitator of FIG. 8.

The drill cuttings agitator 510 of FIGS. 8 and 9 substantially corresponds to the drill cuttings agitator 410 of FIG. 7*a*.

Figure 10:
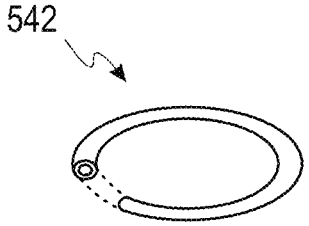
FIG. 10 shows a perspective view of a container of the drill cuttings agitator of FIG. 8.

The drill cuttings agitator 510 further comprises a frangible container 542. The frangible container 542, shown in FIG. 10, is hollow and stores an adhesive. A recess 544 is provided in the inner surface 546 of the elastomeric sleeve 518. The recess 544 is shaped to receive the container 542. In the depicted drill cuttings agitator the recess 544 and the container 542 are annular. In other drill cuttings agitators, the recess and the container may have other forms. A plurality of grooves 548 are also provided in the inner surface 546 of the elastomeric sleeve 518. The grooves 548 are circumferentially spaced apart. The grooves 548 extend axially. The grooves 548 intersect the container groove 544.

The container 542 is configured to break during installation of the drill cuttings agitator 510 on the tubular body 512, and thereby release the adhesive to bond the inner surface 546 to the tubular body 512. The adhesive 510 will flow along the grooves 548, e.g. via capillary action, to distribute the adhesive across the inner surface 546.

Various modifications may be made without departing from the scope of the invention as defined in the claims.

The invention claimed is:

1. A drill cuttings agitator for agitating drill cuttings in a borehole, the drill cuttings agitator comprising:

an elastomeric sleeve; and one or more agitator members extending radially from the elastomeric sleeve, wherein the drill cuttings agitator is reconfigurable between a first configuration in which the elastomeric sleeve has a first inner diameter and a second configuration in which the elastomeric sleeve has a second, larger, inner diameter, the elastomeric sleeve being elastically deformable so as to facilitate reconfiguration of the drill cuttings agitator between the first configuration and the second configuration, wherein the elastomeric sleeve is fully annular in the first configuration and in the second configuration such that the elastomeric sleeve is configured to extend fully circumferentially around an outside of a tubular body in both the first configuration and in the second configuration, wherein reconfiguration of the drill cuttings agitator between the first configuration and the second configuration facilitates location of the drill cuttings agitator on the tubular body, wherein the second configuration is configured to permit the drill cuttings agitator to traverse the tubular body, wherein the elastomeric sleeve is configured to be biased towards the first configuration so as to secure the elastomeric sleeve on the tubular body, and wherein the drill cuttings agitator is configured to rotate with rotation of the tubular body.

2. The drill cuttings agitator of claim 1, wherein the elastomeric sleeve and the one or more agitator members are integrally formed and/or define a single piece, unitary construction.

3. The drill cuttings agitator of claim 1, wherein the elastomeric sleeve and the one or more agitator members are formed from separate components.

4. The drill cuttings agitator of claim 1, wherein the elastomeric sleeve is constructed from rubber, e.g. Hydrogenated Nitrile Butadiene Rubber (HNBR), or urethane.

5. The drill cuttings agitator of claim 1, wherein the one or more agitator members comprise or take a form of paddles.

6. The drill cuttings agitator of claim 1, wherein the drill cuttings agitator comprises a plurality of the one or more agitator members.

7. The drill cuttings agitator of claim 6, wherein the plurality of agitator members are circumferentially arranged and/or spaced around the elastomeric sleeve.

8. The drill cuttings agitator of claim 6, wherein the plurality of agitator members define at least one slot between them.

9. The drill cuttings agitator of claim 8, wherein the at least one slot is a blind slot.

10. The drill cuttings agitator of claim 1, wherein one or more of the one or more agitator members is constructed from an elastomeric material.

11. The drill cuttings agitator of claim 10, wherein the elastomeric material comprises or takes a form of rubber, e.g. Hydrogenated Nitrile Butadiene Rubber (HNBR), or urethane.

12. The drill cuttings agitator of claim 1, wherein the drill cuttings agitator comprises a tapered end portion.

13. The drill cuttings agitator of claim 1, further comprising a container configured to receive and/or releasably store an adhesive for bonding the elastomeric sleeve to the tubular body.

14. The drill cuttings agitator of claim 1, wherein in the first configuration the elastomeric sleeve defines an inner diameter which is smaller than or equal to an outer diameter of the tubular body so that the elastomeric sleeve can define an interference fit with the tubular body.

15. A method of installing a drill cuttings agitator onto a tubular body, comprising:

providing the drill cuttings agitator according to claim 1;

providing the tubular body, reconfiguring the drill cuttings agitator from the first configuration in which the elastomeric sleeve defines the first inner diameter to the second configuration in which the elastomeric sleeve defines the second, larger, inner diameter, to facilitate location of the drill cuttings agitator onto the tubular body; and reconfiguring the drill cuttings agitator from the second configuration to the first configuration to secure the drill cuttings agitator to the tubular body.

16. A downhole tool comprising:

a tubular body; and one or more of the drilling cuttings agitators according to claim 1.

17. The downhole tool of claim 16, wherein the tubular body comprises or takes a form of a drill pipe.

18. The downhole tool of claim 16, wherein the elastomeric sleeve is secured to the tubular body.

19. The downhole tool of claim 18, wherein the elastomeric sleeve is bonded to the tubular body.

20. The downhole tool of claim 16, wherein the tubular body comprises one or more recesses, the one or more recesses configured to receive one or more of the drill cuttings agitators.

21. The downhole tool of claim 16, comprising a plurality of the drill cuttings agitators.

22. A downhole system for agitating drill cuttings, the downhole system comprising one or more of the downhole tool according to claim 19.

23. A method of agitating a cuttings bed in a borehole using the downhole tool of claim 19, the method comprising:

running the downhole tool or downhole tool system, on a drill string, to a vicinity of the cuttings bed in the borehole; and rotating the tubular body such that the drill cuttings agitator agitates the cuttings bed.

24. The method of claim 15, wherein the drill cuttings agitator is deformed to its second configuration in which the elastomeric sleeve defines its second, larger, inner diameter when the elastomeric sleeve is around a tool connection joint upset of the tubular body.

25. An assembly for installing the drill cuttings agitator according to claim 1 onto the tubular body, the assembly comprising a forcing cone configured for reconfiguring the drill cuttings agitator from the first configuration in which the elastomeric sleeve defines the first inner diameter to the second configuration in which the elastomeric sleeve defines its second, larger, inner diameter, to facilitate location of the drill cuttings agitator onto the tubular body.

26. The assembly of claim 25, wherein the assembly comprises a finger arrangement, and wherein the finger arrangement comprises a radial array of biased members configured to conform to the elastomeric sleeve as it expands and contracts during installation.

27. The assembly of claim 26, wherein the biased members are spring loaded, hydraulically loaded and/or pneumatically loaded.

28. The drill cuttings agitator of claim 13, wherein the container is frangible, breakable and/or degradable.

29. The drill cuttings agitator of claim 13, wherein the elastomeric sleeve comprises one or more grooves for communicating the adhesive.

30. The drill cuttings agitator of claim 29, wherein at least one of:

the one or more grooves are on an internal surface of the elastomeric sleeve;

the one or more grooves extend axially;

the one or more grooves are capillary grooves.

31. A drill cuttings agitator for agitating drill cuttings in a borehole, the drill cuttings agitator comprising:

an elastomeric sleeve;

one or more agitator members extending radially from the elastomeric sleeve; and a container configured to receive and/or releasably store an adhesive for bonding the elastomeric sleeve to a tubular body.

32. An assembly for installing a drill cuttings agitator onto a tubular body, the drill cuttings agitator comprising:

an elastomeric sleeve; and one or more agitator members extending radially from the elastomeric sleeve;

the assembly comprising a forcing cone configured for reconfiguring the drill cuttings agitator from a first configuration in which the elastomeric sleeve defines a first inner diameter to a second configuration in which the elastomeric sleeve defines a second, larger, inner diameter, to facilitate location of the drill cuttings agitator onto the tubular body.

* * * * *